US005424159A

United States Patent [19]

Mashimo et al.

[11] Patent Number: 5,424,159

[45] Date of Patent: Jun. 13, 1995

[54] ELECTROPHOTOGRAPHIC PHOTORECEPTOR

[75] Inventors: Kiyokazu Mashimo; Fumio Ojima; Toru Ishii; Tomoo Kobayashi; Taketoshi Hoshizaki; Ryosaku Igarashi; Tomozumi Uesaka, all of Minami-ashigara, Japan

[73] Assignee: Fuji Xerox Co., Ltd., Tokyo, Japan

[21] Appl. No.: 102,246

[22] Filed: Aug. 5, 1993

[30] Foreign Application Priority Data

Aug. 13, 1992 [JP] Japan ..... 4-236320
Oct. 19, 1992 [JP] Japan ..... 4-304406

[51] Int. Cl.[6] ..... G03G 5/09

[52] U.S. Cl. ..... 430/83; 430/59; 430/96

[58] Field of Search ..... 430/58, 59, 96, 83

[56] References Cited

U.S. PATENT DOCUMENTS 4,833,054 5/1989 Akasaki et al. ..... 430/59
4,956,256 9/1990 Ohtsuka et al. ..... 430/96
4,999,268 3/1991 Ojima et al. ..... 430/59

FOREIGN PATENT DOCUMENTS 57-195254 11/1982 Japan .
60-172044 9/1985 Japan .
62-247374 10/1987 Japan .
63-148263 6/1988 Japan .
2-52257 11/1990 Japan .

*Primary Examiner*—Roland Martin
*Attorney, Agent, or Firm*—Oliff & Berridge

[57] ABSTRACT

An electrophotographic photoreceptor comprising a conductive substrate having formed thereon a photosensitive layer containing at least a charge generating material, a charge transporting material, and a binder resin, wherein said charge transporting material comprises a benzidine compound and/or a low-molecular weight charge transporting material having a molecular weight of from 200 to 400 and said binder resin mainly comprises a polycarbonate resin comprising a recurring unit represented by formula (I):

(I)

and having a viscosity-average molecular weight ranging from 50,000 and 100,000, said charge transporting material and said binder resin being at a weight ratio of from 25:75 to 60:40. The photoreceptor exhibits improved abrasion resistance and improved peeling resistance while retaining excellent electrical and image characteristics.

9 Claims, 1 Drawing Sheet

ELECTROPHOTOGRAPHIC PHOTORECEPTOR

FIELD OF THE INVENTION

This invention relates to an electrophotographic photoreceptor and more particularly to a highly durable electrophotographic photoreceptor excellent in abrasion resistance, cleaning properties, and environmental stability.

BACKGROUND OF THE INVENTION

Electrophotography has undergone a marked development in the field of copying machines, laser beam printers, and the like because of the advantages of high speed and high image quality.

Photoreceptors conventionally widespread in electrophotography are those comprising inorganic photoconductive materials, such as selenium, selenium-tellurium alloys, selenium-arsenic alloys, and cadmium sulfide.

Organic photoreceptors comprising organic photoconductive materials have also been studied with attention being paid on their merits over inorganic photoreceptors, such as cheapness, productivity, and ease of disposal. In particular, organic photoreceptors of separate function type having a laminate structure composed of a charge generating layer which functions to generate charge on exposure to light and a charge transporting layer which functions to transport the generated charge are excellent in electrophotographic characteristics, such as sensitivity, charging properties, and stability of these properties on repeated use. Various proposals on this type of photoreceptors have been made to date, and some of them have been put to practical use.

While organic laminate type photoreceptors with sufficient performance in terms of the above-mentioned electrophotographic characteristics have been developed, there still remains an unsolved problem of durability against mechanical outer force in nature of the organic materials used. That is, being made of an organic material, a photosensitive layer easily undergoes abrasion or scratches on direct imposition of loads from a toner, a developer, a transfer medium (e.g., paper), a cleaning member, and the like and tends to suffer from adhesion of foreign substances due to a toner filming phenomenon, etc., which results in image defects. Besides, low-resistant substances, such as corona discharge-induced ozone and nitrogen oxides, and paper dust from copying paper are liable to adhere and be deposited on the surface of the photoreceptor, which leads to image running under a high humidity condition. The working life of an organic photoreceptor has been considerably limited by these phenomena.

On the other hand, with the recent advancement in color image formation and high-speed recording with copying machines and color printers, the process involved has been getting more complicated, and the stress laid on a photoreceptor has been increasing. From this viewpoint, the demand for improved durability of an electrophotographic photoreceptor has been increasing.

A number of measures have ever been proposed to improve durability of an electrophotographic photoreceptor. For example, various polycarbonate resins have been suggested as a binder resin for the surface layer of a photoreceptor (see JP-A-60-172044 and JP-A-62-247374, and U.S. Pat. No. 4,956,256; the term "JP-A" as used herein means an "unexamined published Japanese patent application").

Use of the known binder resins somewhat achieved improvement on durability, but the state-of-the-art photoreceptors are still unsatisfactory. That is, the coating film comprising a known binder resin does not always have sufficient mechanical strength and, when repeatedly used in a copying machine for a long time, it reduces its thickness due to abrasion and thereby reduces its sensitivity. It follows that fog develops or the charging potential decreases to reduce the image density. Image defects also develop due to scratches or adhesion of foreign substances by toner filming, etc. Further, since a charge transporting material is not sufficiently durable against discharge products, image running is apt to occur particularly in a high temperature and high humidity environment.

In addition, compatibility between a binder resin and a charge transporting material is of importance. If the compatibility is poor, it is known that part of the charge transporting material crystallizes to give serious influences on electric characteristics and image characteristics.

SUMMARY OF THE INVENTION

An object of the present invention is to provide an electrophotographic photoreceptor which has improved abrasion resistance and improved peeling resistance while retaining excellent electric and image characteristics inherent in photoreceptors.

The present inventors have conducted extensive investigations on combination of a binder resin and a charge transporting material constituting a photosensitive layer and, as a result, found that improvements on abrasion resistance and peeling resistance can be achieved while retaining essentially possessed electric and image characteristics by using combination of a benzidine charge transporting material or a low-molecular weight charge transporting material having a molecular weight of from 200 to 400 and a polycarbonate resin comprising a recurring unit represented by formula (I):

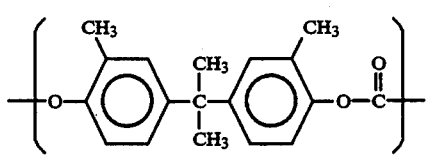

(I)

and having a viscosity-average molecular weight of from 50,000 and 100,000 at a specific ratio. The present invention has been completed based on this finding.

The present invention provides an electrophotographic photoreceptor comprising a conductive substrate having formed thereon a photosensitive layer containing at least a charge generating material, a charge transporting material, and a binder resin, wherein said charge transporting material is a benzidine compound and/or a low-molecular weight charge transporting material having a molecular weight of from 200 to 400 and said binder resin mainly comprises a polycarbonate resin comprising a recurring unit represented by formula (I) and having a viscosity-average molecular weight ranging from 50,000 and 100,000, said charge transporting material and said binder resin being at a weight ratio of from 25:75 to 60:40.

The benzidine compound preferably includes a compound represented by formula (II):

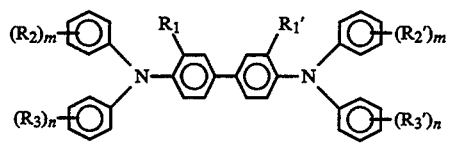

(II)

wherein $R_1$ and $R_1'$, which may be the same or different, each represent a hydrogen atom, an alkyl group having from 1 to 5 carbon atoms, an alkoxy group having from 1 to 5 carbon atoms or a halogen atom; $R_2$, $R_2'$, $R_3$, and $R_3'$, which may be the same or different, each represent a hydrogen atom, an alkyl group having from 1 to 5 carbon atoms, an alkoxy group having from 1 to 5 carbon atoms, a halogen atom or a substituted amino group; and m and n each represent 1 or 2.

The substituted amino group is preferably selected from the group consisting of —NHR and —$N(R)_2$ wherein R is an alkyl group having from 1 to 5 carbon atoms.

The low-molecular weight charge transporting material having a molecular weight of from 200 to 400 preferably includes a triphenylamine compound represented by formula (III):

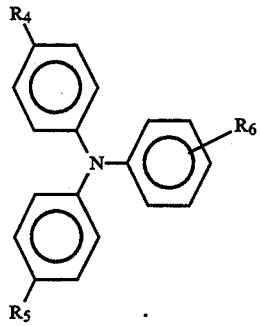

(III)

wherein $R_4$ and $R_5$, which may be the same or different, each represent a hydrogen atom, an alkyl group having from 1 to 3 carbon atoms or an alkoxy group having from 1 to 3 carbon atoms; and $R_6$ represents a hydrogen atom, an alkyl group having from 1 to 3 carbon atoms or an aryl group having from 6 to 12 carbon atoms which may be substituted with one or two alkyl groups each having from 1 to 3 carbon atoms.

DETAILED DESCRIPTION OF THE INVENTION

The electrophotographic photoreceptor according to the present invention comprises a conductive substrate having thereon at least a photosensitive layer containing at least a charge generating material, a charge transporting material, and a binder resin. The photosensitive layer may have either a single layer structure or a separate function type laminate structure composed of a charge generating layer and a charge transporting layer.

Figure 1:
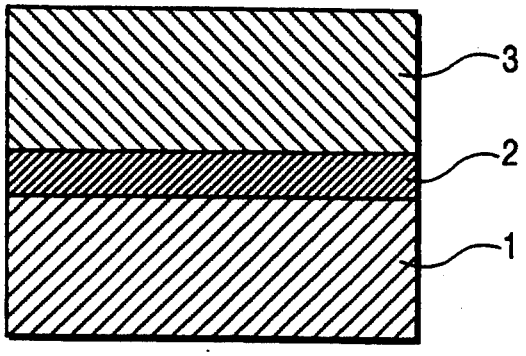
FIGS. 1 and 2 each illustrate a schematic cross section of an electrophotographic photoreceptor according to the present invention.
Figure 2:
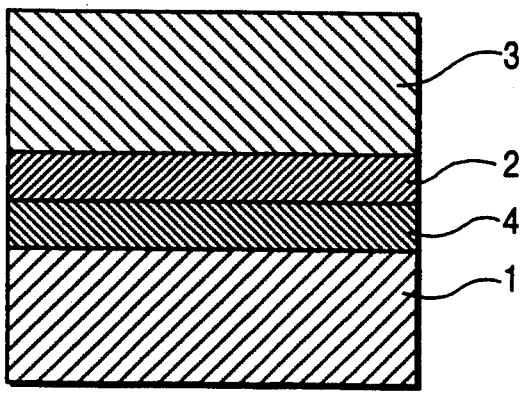

In FIGS. 1 and 2 are each shown a schematic cross section of the laminate type electrophotographic photoreceptor according to the present invention. The photoreceptor of FIG. 1 comprises conductive substrate 1 having thereon a photosensitive layer composed of charge generating layer 2 and charge transporting layer 3 in this order. The photoreceptor of FIG. 2 additionally has subbing layer 4 between conductive substrate 1 and charge generating layer 2.

Conductive substrate 1 which can be used in the present invention includes metals, e.g., aluminum, nickel, chromium, stainless steel, etc.; plastic films having a conductive thin film of aluminum, titanium, nickel, chromium, stainless steel, gold, vanadium, tin oxide, indium oxide or indium-tin oxide (ITO); and paper or plastic films coated or impregnated with a conductivity-imparting material. While not limiting, these substrate materials are usually used in a drum form, a sheet form or a plate form. If desired, the conductive substrate may be subjected to various surface treatments as far as image quality is not impaired. Suitable surface treatments include oxidation, chemical treatments, coloring, and treatments for irregular reflection, such as surface graining.

The charge generating materials which can be used in charge generating layer 2 include inorganic photoconductive materials, e.g., amorphous selenium, crystalline selenium-tellurium alloys, selenium-arsenic alloys, other selenium compounds and alloys, zinc oxide, and titanium oxide; and organic pigments or dyes, e.g., phthalocyanine pigments, squarylium pigments, anthanthrone pigments, perylene pigments, azo pigments or dyes, anthraquinone dyes, pyrene compounds, pyrylium salts, and thiapyrylium salts.

Binder resins which can be used in the charge generating layer include, while not limiting, polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenolic resins, and poly-N-vinylcarbazole resins. These binder resins may be used either individually or in combination of two or more thereof.

Solvents to be used for formation of a charge generating layer are methanol, ethanol, n-propyl alcohol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, and chloroform. These organic solvents may be used either individually or in combination of two or more thereof.

A suitable mixing ratio of a charge generating material to a binder resin is from 10:1 to 1:10 by weight.

Coating of a coating composition comprising a charge generating material, a binder resin, and a solvent can be carried out by any of known techniques, such as blade coating, wire bar coating, spray coating, dip coating, bead coating, air knife coating, and curtain coating.

A charge generating layer usually has a thickness of from 0.1 to 5 μm, and preferably from 0.2 to 2.0 μm.

The charge transporting material which can be used in charge transporting layer 3 is selected from a benzidine compound and a low-molecular weight charge transporting material having a molecular weight ranging from 200 to 400.

The benzidine compound preferably includes a compound represented by formula (II), and the low-molecular weight charge transporting material having a molecular weight of from 200 to 400 preferably includes a triphenylamine compound represented by formula (III). Specific examples of the benzidine compounds of formula (II) and the triphenylamine are shown in Tables 1 and 2 below, compounds of formula (III) respectively.

TABLE 1

| Compound No. | $R_1$, $R_1'$ | $R_2$, $R_2'$ | $R_3$, $R_3'$ |
|---|---|---|---|
| II-1 | $CH_3$ | H | H |
| II-2 | $CH_3$ | 2-$CH_3$ | H |
| II-3 | $CH_3$ | 3-$CH_3$ | H |
| II-4 | $CH_3$ | 4-$CH_3$ | H |
| II-5 | $CH_3$ | 4-$CH_3$ | 2'-$CH_3$ |
| II-6 | $CH_3$ | 4-$CH_3$ | 3'-$CH_3$ |
| II-7 | $CH_3$ | 4-$CH_3$ | 4'-$CH_3$ |
| II-8 | $CH_3$ | 3,4-$CH_3$ | H |
| II-9 | $CH_3$ | 3,4-$CH_3$ | 3',4'-$CH_3$ |
| II-10 | $CH_3$ | 4-$C_2H_5$ | H |
| II-11 | $CH_3$ | 4-$C_3H_7$ | H |
| II-12 | $CH_3$ | 4-$C_4H_9$ | H |
| II-13 | $CH_3$ | 4-$C_2H_5$ | 2'-$CH_3$ |
| II-14 | $CH_3$ | 4-$C_2H_5$ | 3'-$CH_3$ |
| II-15 | $CH_3$ | 4-$C_2H_5$ | 4'-$CH_3$ |
| II-16 | $CH_3$ | 4-$C_2H_5$ | 3',4'-$CH_3$ |
| II-17 | $CH_3$ | 4-$C_3H_7$ | 3'-$CH_3$ |
| II-18 | $CH_3$ | 4-$C_3H_7$ | 4'-$CH_3$ |
| II-19 | $CH_3$ | 4-$C_4H_9$ | 3'-$CH_3$ |
| II-20 | $CH_3$ | 4-$C_4H_9$ | 4'-$CH_3$ |
| II-21 | $CH_3$ | 4-$C_2H_5$ | 4'-$C_2H_5$ |
| II-22 | $CH_3$ | 4-$C_2H_5$ | 4'-$OCH_3$ |
| II-23 | $CH_3$ | 4-$C_3H_7$ | 4'-$C_3H_7$ |
| II-24 | $CH_3$ | 4-$C_3H_7$ | 4'-$OCH_3$ |
| II-25 | $CH_3$ | 4-$C_4H_9$ | 4'-$C_4H_9$ |
| II-26 | $CH_3$ | 4-$C_4H_9$ | 4'-$OCH_3$ |
| II-27 | H | 3-$CH_3$ | H |
| II-28 | Cl | H | H |
| II-29 | Cl | 2-$CH_3$ | H |
| II-30 | Cl | 3-$CH_3$ | H |
| II-31 | Cl | 4-$CH_3$ | H |
| II-32 | Cl | 4-$CH_3$ | 2'-$CH_3$ |
| II-33 | Cl | 4-$CH_3$ | 3'-$CH_3$ |
| II-34 | Cl | 4-$CH_3$ | 4'-$CH_3$ |
| II-35 | $C_2H_5$ | H | H |
| II-36 | $C_2H_5$ | 2-$CH_3$ | H |
| II-37 | $C_2H_5$ | 3-$CH_3$ | H |
| II-38 | $C_2H_5$ | 4-$CH_3$ | H |
| II-39 | $C_2H_5$ | 4-$CH_3$ | 4'-$CH_3$ |
| II-40 | $C_2H_5$ | 4-$C_2H_5$ | 4'-$CH_3$ |
| II-41 | $C_2H_5$ | 4-$C_3H_7$ | 4'-$CH_3$ |
| II-42 | $C_2H_5$ | 4-$C_4H_9$ | 4'-$CH_3$ |
| II-43 | $OCH_3$ | H | H |
| II-44 | $OCH_3$ | 2-$CH_3$ | H |
| II-45 | $OCH_3$ | 3-$CH_3$ | H |
| II-46 | $OCH_3$ | 4-$CH_3$ | H |
| II-47 | $OCH_3$ | 4-$CH_3$ | 4'-$CH_3$ |
| II-48 | $OCH_3$ | 4-$C_2H_5$ | 4'-$CH_3$ |
| II-49 | $OCH_3$ | 4-$C_3H_7$ | 4'-$CH_3$ |
| II-50 | $OCH_3$ | 4-$C_4H_9$ | 4'-$CH_3$ |
| II-51 | $CH_3$ | 2-$N(CH_3)_2$ | H |
| II-52 | $CH_3$ | 3-$N(CH_3)_2$ | H |
| II-53 | $CH_3$ | 4-$N(CH_3)_2$ | H |
| II-54 | $CH_3$ | 4-Cl | H |

TABLE 2

| Compound No. | $R_4$ | $R_5$ | $R_6$ |
|---|---|---|---|
| III-1 | $CH_3$ | $CH_3$ | 4-$CH_3$ |
| III-2 | $CH_3$ | $CH_3$ | 4-$C_6H_5$ |
| III-3 | $C_2H_5$ | $CH_3$ | 4-$CH_3$ |
| III-4 | $C_2H_5$ | $C_2H_5$ | 4-$C_6H_5$ |
| III-5 | $CH_3$ | $CH_3$ | 4-$C_2H_5$ |
| III-6 | H | H | 4-$C_6H_5$ |
| III-7 | H | H | 4-$CH_3$ |
| III-8 | H | H | 4-$C_2H_5$ |
| III-9 | $CH_3$ | $CH_3$ | 2-$CH_3$ |
| III-10 | $CH_3$ | $CH_3$ | bi-$C_6H_5$ |

TABLE 2-continued

| Compound No. | $R_4$ | $R_5$ | $R_6$ |
|---|---|---|---|
| III-11 | $OCH_3$ | $OCH_3$ | 4-$CH_3$ |

The low-molecular weight charge transporting material further includes a hydrazone compound represented by formula (IV):

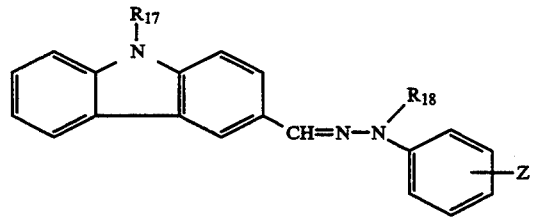

(IV)

wherein $R_{17}$ represents an alkyl group having from 1 to 5 carbon atoms, $R_{18}$ represents an alkyl group having from 1 to 5 carbon atoms or a phenyl group, and Z represents a hydrogen atom, an alkyl group having from 1 to 5 carbon atoms, an alkoxy group having from 1 to 5 carbon atoms or a halogen atom.

The charge transporting material to be used in the present invention are by no means limited to the specific compounds listed in Tables 1 and 2. For example, while in all the compounds in Table 1, for the sake of convenience, the substituents for $R_1'$, $R_2'$, and $R_3'$ are the same as those for $R_1$, $R_2$ and $R_3$, respectively, $R_1$ and $R_1'$, $R_2$ and $R_2'$, and $R_3$ and $R_3'$ may not always be the same. Likewise, the position of $R_1'$, $R_2'$ or $R_3'$ may not be the same as that of $R_1$, $R_2$ or $R_3$, respectively.

These charge transporting materials may be used either individually or in combination of two or more thereof.

Of the benzidine compounds represented by formula (II), compounds represented by formula (V):

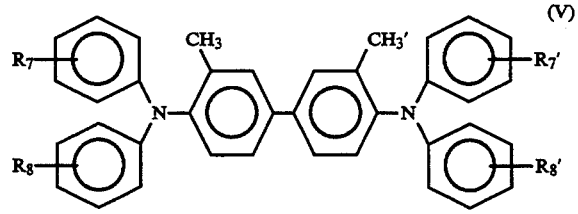

(V)

wherein $R_7$, $R_7'$, $R_8$, and $R_8'$, which may be the same or different, each represent a hydrogen atom or a methyl group, and compounds represented by formula (VI):

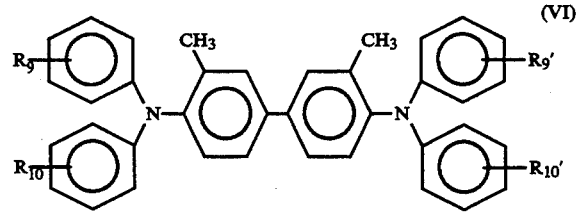

(VI)

wherein $R_9$ and $R_9'$, which may be the same or different, each represent an alkyl group having 2 or more carbon atoms; and $R_{10}$ and $R_{10}'$, which may be the same or different, each represent a hydrogen atom, an alkyl group, an alkoxy group or a substituted amino group, have high solubility in a solvent and high compatibility with the polycarbonate resin having a recurring unit of formula (I) and thereby provide a uniform coating film as previously disclosed by the present inventors in JP-A-62-247374. These compounds are therefore capable of forming a uniform interface to provide an electrophotographic photoreceptor having high sensitivity and stability on repeated use, and are particularly preferred.

The benzidine compound of formula (II) and the low-molecular weight charge transporting material having a molecular weight of from 200 to 400 may be used either alone or in combination thereof. When combined, a mixing ratio of the former to the latter ranges from 80:20 to 20:80, and preferably from 60:40 to 40:60, by weight.

A polycarbonate resin mainly comprising a polycarbonate resin having a recurring unit of formula (I) and having a viscosity-average molecular weight of from 50,000 to 100,000, preferably from 50,000 to 70,000 (hereinafter referred to as polycarbonate (I)) are used as a binder resin in the charge transporting layer. If the viscosity-average molecular weight of polycarbonate (I) is less than 50,000, the coating composition has too low a viscosity to obtain a desired film thickness and only tends to provide a coating film having an uneven thickness when, for example, dip coated and easily suffering from scratches. If the viscosity-average molecular weight exceeds 100,000, the high viscosity of the coating composition makes it very difficult to control the film thickness.

The binder resin may be a mixture of polycarbonates (I) differing in viscosity-average molecular weight within the range of from 50,000 to 100,000. Polycarbonate(s) (I) may be used in combination with other polycarbonate resins as far as the actions and effects of polycarbonate (I) are not impaired.

The above-mentioned charge transporting material and binder resin are used at a weight ratio of from 25:75 to 60:40, preferably from 30:70 to 50:50. If the proportion of the charge transporting material is less than 25% by weight based on the total weight of the charge transporting material and the binder resin, electric characteristics of the resulting layer are considerably reduced to impair the functions as a photoreceptor. If the proportion is more than 60% by weight, abrasion resistance, peeling resistance, and resistance to discharge products are extremely deteriorated.

The polycarbonate resin comprising a recurring unit represented by formula (I) is produced by the method as disclosed in U.S. Pat. No. 4,956,256.

The benzidine compound represented by formula (II) is produced by the method as disclosed in U.S. Pat. No. 4,833,054.

The triphenylamine compound represented by formula (III) is produced by the method as disclosed in JP-A-57-195254. Specifically, the triphenylamine compound (III) is synthesized by reacting a primary or secondary arylamine with a halogenated aryl compound in the presence of a base and as a catalyst, copper. More specifically, for example, Compound III-1 can be produced by reacting p,p'-ditolylamine with p-iodotoluene in the presence of anhydrous potassium carbonate and copper powder at about 200° C. for several ten hours and then removing the insoluble matter with a solvent such as toluene, etc. The thus obtained compound may further be recrystallized for purification.

Suitable solvents to be used in the charge transporting layer formation include aromatic hydrocarbons, e.g., benzene, toluene and xylene; halogenated aromatic hydrocarbons, e.g., monochlorobenzene; ketones, e.g., acetone and 2-butanone; halogenated aliphatic hydrocarbons, e.g., methylene chloride, chloroform, and ethylene chloride; cyclic or acyclic ethers, e.g., tetrahydrofuran and ethyl ether; and mixtures thereof.

The same coating techniques as used for the charge generating layer formation apply to the charge transporting layer formation.

The charge transporting layer usually has a thickness of from 5 to 50 μm, and preferably from 10 to 30 μm.

Where a photosensitive layer has a single layer structure, a photosensitive layer comprises a charge generating material, a charge transporting material, and a binder resin. The charge generating materials and charge transporting materials to be used are the same as those described above with reference to a laminate type photosensitive layer can be used. The same polycarbonate resin systems as used in the charge transporting layer of the laminate type photosensitive layer are used as a binder resin. The charge transporting material and the binder resin are used at a weight ratio of from 25:75 to 60:40.

If desired, subbing layer 4 may be provided between conductive substrate 1 and photosensitive layer (charge generating layer 2 in case of a laminate type photosensitive layer). Subbing layer 4 functions to block injection of charge from conductive substrate 1 to a photosensitive layer at the time of charging and also serves as an adhesive layer between conductive substrate 1 and a photosensitive layer. In some cases, subbing layer 4 functions to prevent reflection of light on a conductive substrate.

Suitable materials for forming a subbing layer include binder resins, such as polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, and polyacrylamide. In addition, zirconium chelate compounds, organotitanium compounds (e.g., titanyl chelate compounds and titanium alkoxides), and silane coupling agents may also be used.

A subbing layer is coated on a conductive substrate by a generally employed coating technique, such as blade coating, wire bar coating, spray coating, dip coating, bead coating, air knife coating, and curtain coating.

A subbing layer usually has a thickness of from 0.01 to 10 μm, and preferably from 0.05 to 2 μm.

For the purpose of protecting a photoreceptor from ozone or oxidizing gases generated in a copying machine or heat and light, antioxidants, photostabilizers, heat stabilizers, or the like additives may be added to a photosensitive layer.

Examples of usable antioxidants include hindered phenols, hindered amines, p-phenylenediamine, an arylalkane, hydroquinone, spirocoumarone, spiroindanone, derivatives of these compounds, organic sulfur compounds, and organic phosphorus compounds.

Examples of usable photostabilizers are benzophenone, benzotriazole, dithiocarbamate, tetramethylpiperidine, and derivatives thereof.

For the purpose of improving sensitivity, reducing a residual potential, and reducing fatigue from repeated use, one or more electron accepting substances may be incorporated into a photosensitive layer. Suitable examples of electron accepting substances which can be used in the present invention are succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Preferred of them are fluorenone type compounds, quinone type compounds, and benzene derivatives having an electron attracting substituent, e.g., Cl, CN or $NO_2$.

The present invention will now be illustrated in greater detail with reference to Examples, but it should be understood that the present invention is not construed as being limited thereto. All the parts are by weight unless otherwise indicated.

EXAMPLE 1

A solution consisting of 10 parts of a zirconium compound (Orgatics ZC540 produced by Matsumoto Seiyaku Co., Ltd.), 1 part of a silane compound (A1110 produced by Japan Unicar Co., Ltd.), 40 parts of isopropyl alcohol, and 20 parts of butanol was coated on an aluminum pipe by dip coating and dried at 150° C. for 10 minutes to form a 0.1 μm thick subbing layer.

One part of x-type metal-free phthalocyanine crystals was mixed with 1 part of a polyvinyl butyral resin (S-Lec BM-S produced by Sekisui Chemical Co., Ltd.) and 100 parts of cyclohexanone, and the mixture was dispersed in a sand mill together with glass beads for 1 hour. The resulting coating composition was coated on the subbing layer by dip coating and dried by heating at 100° C. for 10 minutes to form a charge generating layer having a thickness of 0.25 μm.

In 85 parts of monochlorobenzene were dissolved 8 parts of Compound II-27 (benzidine compound (II)) and 12 parts of polycarbonate (I) (viscosity-average molecular weight (Mv): 60,000), and the resulting coating composition was coated on the charge generating layer by dip coating and dried by heating at 135° C. for 1 hour to form a charge transporting layer having a thickness of 20 μm. The conditions of the coating film (film properties) were observed with the naked eye.

EXAMPLE 2

An electrophotographic photoreceptor was prepared in the same manner as in Example 1, except for replacing Compound II-27 with Compound II-15.

EXAMPLE 3

An electrophotographic photoreceptor was prepared in the same manner as in Example 1, except for forming the charge transporting layer using a coating composition comprising 10 parts of Compound III-1 (triphenylamine compound (III)), 10 parts of polycarbonate (I) (Mv: 80,000), and 80 parts of monochlorobenzene.

Comparative Example 1

An electrophotographic photoreceptor was prepared in the same manner as in Example 1, except for changing the viscosity-average molecular weight (Mv) of polycarbonate (I) to 40,000.

Comparative Example 2

Preparation of an electrophotographic photoreceptor was attempted in the same manner as in Example 1, except for changing the viscosity-average molecular weight (Mv) of polycarbonate (I) to 110,000. The coating composition had too high a viscosity to be coated.

Comparative Example 3

An electrophotographic photoreceptor was prepared in the same manner as in Example 1, except for forming the charge transporting layer using a coating composition comprising 4 parts of Compound II-27, 16 parts of polycarbonate (I) (Mv: 60,000), and 120 parts of monochlorobenzene.

Comparative Example 4

An electrophotographic photoreceptor was prepared in the same manner as in Example 1, except for forming the charge transporting layer using a coating composition comprising 13 parts of Compound II-27, 7 parts of polycarbonate (I) (Mv: 60,000), and 75 parts of monochlorobenzene.

EXAMPLE 4

An electrophotographic photoreceptor was prepared in the same manner as in Example 1, except for replacing Compound II-27 with 10 parts of a hydrazone compound represented by formula (VII) shown below and changing the amount of polycarbonate (I) (Mv: 60,000) to 10 parts.

(VII)

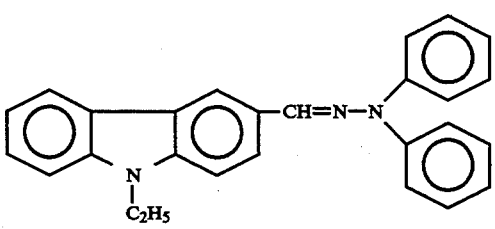

Comparative Example 5

An electrophotographic photoreceptor was prepared in the same manner as in Example 3, except for replacing Compound III-1 with a hydrazone compound represented by formula (XI):

(XI)

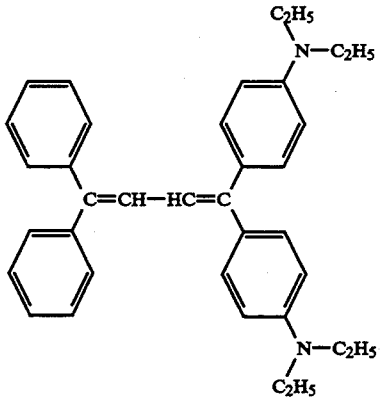

Comparative Example 6

An electrophotographic photoreceptor was prepared in the same manner as in Example 1, except for replacing Compound II-27 with a stilbene compound represented by formula (VIII):

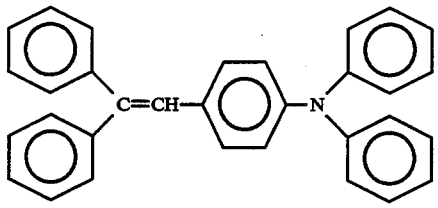

(VIII)

to 4 and Comparative Examples 1 to 8 were evaluated by using an electrostatic paper analyzer EPA-8000 (manufactured by Kawaguchi Denki Co., Ltd.) as follows.

A photoreceptor was charged to −6 kV by corona discharge under normal ambient conditions (20° C., 40% RH) and then exposed to monochromatic light of 800 nm isolated from light of a tungsten lamp by a monochromator and adjusted to an illuminance of 1 $\mu W/cm^2$. The initial surface potential $V_O$(V) and sensitivity $E_{\frac{1}{2}}$ (erg/cm$^2$) were measured. The photoreceptor was then exposed to white light of 10 lux for 1 second, and the residual potential $V_{RP}$(V) was measured. The results of the measurements are shown in Table 3 below. The film properties on the photoreceptor surface were also shown in the Table.

TABLE 3

| Example No. | Charge Transporting Layer: Charge Material Kind | Amount (wt %) | Mw | Binder Resin Kind | Mv | Film Thickness (μm) | Film Properties | Electric Characteristics: $V_0$ (V) | $E_{\frac{1}{2}}$ (erg/cm$^2$) | $V_{RP}$ (V) |
|---|---|---|---|---|---|---|---|---|---|---|
| Example 1 | II-27 | 40 | — | (I) | 60,000 | 20.0 | good | −823 | 8.1 | −53 |
| Example 2 | II−15 | 40 | — | (I) | 60,000 | 21.5 | good | −818 | 7.8 | −49 |
| Example 3 | III−1 | 50 | 287.39 | (I) | 80,000 | 20.4 | good | −810 | 8.2 | −51 |
| Example 4 | (VII) | 50 | 389.41 | (I) | 60,000 | 20.1 | partly crystallized | −811 | 9.4 | −85 |
| Comp. Ex. 1 | II−27 | 40 | — | (I) | 40,000 | 15.0 | sagging | −710 | 7.9 | −23 |
| Comp. Ex. 2 | II−27 | 40 | — | (I) | 110,000 | | incapable of coating | | | |
| Comp. Ex. 3 | II−27 | 20 | — | (I) | 60,000 | 20.2 | good | −872 | 20.6 | −250 |
| Comp. Ex. 4 | II−27 | 65 | — | (I) | 60,000 | 21.0 | good | −780 | 7.2 | −32 |
| Comp. Ex. 5 | (XI) | 50 | 500 | (I) | 80,000 | 21.0 | partly crystallized | −795 | 9.5 | −102 |
| Comp. Ex. 6 | (VIII) | 40 | 423.16 | (I) | 60,000 | 20.0 | partly crystallized | −780 | 8.9 | −92 |
| Comp. Ex. 7 | II−27 | 40 | — | (IX) | 36,000 | 22.0 | good | −821 | 8.2 | −61 |
| Comp. Ex. 8 | II−27 | 40 | — | (X) | 40,000 | 21.0 | good | −819 | 8.3 | −55 |

Comparative Example 7

An electrophotographic photoreceptor was prepared in the same manner as in Example 1, except for replacing polycarbonate (I) (Mv: 60,000) with a polycarbonate resin having a recurring unit represented by formula (IX) shown below (Mv: 36,000) and replacing monochlorobenzene with methylene chloride.

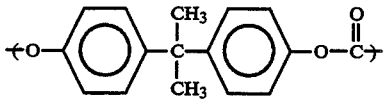

(IX)

Comparative Example 8

An electrophotographic photoreceptor was prepared in the same manner as in Example 1, except for replacing polycarbonate (I) (Mv: 60,000) with a polycarbonate resin having a recurring unit represented by formula (X) shown below (Mv: 40,000).

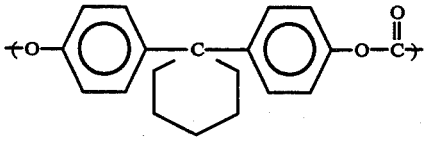

(X)

Electrophotographic characteristics of the electrophotographic photoreceptors prepared in Examples 1

EXAMPLES 5 TO 8

An electrophotographic photoreceptors were prepared in the same manner as in Examples 1 to 4.

Each photoreceptor was set in a digital full color copying machine A-COLOR 630 manufactured by Fuji Xerox Co., Ltd., and 30,000 copies were taken. Image quality of the copies obtained thereafter was evaluated, and the abrasion loss (nm/kcy) of the photosensitive layer was measured. The results obtained are shown in Table 4 below.

Comparative Example 9 to 15

An electrophotographic photoreceptors were prepared in the same manner as in Comparative Examples 1 and 3 to 8.

Each photoreceptor was evaluated in the same manner as in Example 5. The results obtained are shown in Table 4.

TABLE 4

| Example No. | Abrasion Loss (nm/kcy) | Image Quality (after taking 30,000 copies) |
|---|---|---|
| Example 5 | 15.0 | No defect |
| Example 6 | 14.3 | No defect |
| Example 7 | 12.8 | No defect |
| Example 8 | 25.3 | No defect |
| Comparative Example 9 | 28.3 | Scratches due to abrasion. Development of toner filming. |
| Comparative Example 10 | 12.0 | Development of overall fog from the initial stage. |
| Comparative Example 11 | 53.2 | Development of image running due to adhesion of discharge products from |

TABLE 4-continued

| Example No. | Abrasion Loss (nm/kcy) | Image Quality (after taking 30,000 copies) |
|---|---|---|
| | | the initial stage. |
| Comparative Example 12 | 20.2 | Occurrence of many black spots. Scratches due to abrasion. Development of toner filming. |
| Comparative Example 13 | 33.0 | Scratches due to abrasion. Development of toner filming. |
| Comparative Example 14 | 38.0 | Scratches due to abrasion. Development of toner filming. |
| Comparative Example 15 | 27.0 | Scratches due to abrasion. |

EXAMPLE 9

A solution consisting of 10 parts of a zirconium compound (Orgatics ZC540), 1 part of a silane compound (A1110), 40 parts of isopropyl alcohol, and 20 parts of butanol was coated on an aluminum substrate by dip coating and dried at 150° C. for 10 minutes to form a 0.1 μm thick subbing layer.

One part of x-type metal-free phthalocyanine crystals was mixed with 1 part of a polyvinyl butyral resin (S-Lec BM-S) and 100 parts of cyclohexanone, and the mixture was dispersed in a sand mill together with glass beads for 1 hour. The resulting coating composition was coated on the subbing layer by dip coating and dried by heating at 100° C. for 10 minutes to form a charge generating layer having a thickness of 0.25 μm.

In 85 parts of monochlorobenzene were dissolved 8 parts of Compound III-1 (triphenylamine compound (III)), 2 parts of Compound II-27 (benzidine compound (II)), and 10 parts of polycarbonate resin (I) (Mv: 60,000), and the resulting coating composition was coated on the charge generating layer by dip coating and dried by heating at 115° C. for 1 hour to form a charge transporting layer having a thickness of 20 μm. The conditions of the coating film (film properties) were observed with the naked eye.

EXAMPLE 10

An electrophotographic photoreceptor was prepared in the same manner as in Example 9, except for replacing Compound II-27 with Compound II-15.

EXAMPLE 11

An electrophotographic photoreceptor was prepared in the same manner as in Example 9, except for replacing Compound III-1 with Compound III-10.

EXAMPLE 12

An electrophotographic photoreceptor was prepared in the same manner as in Example 9, except for changing the amounts of Compound III-1 and Compound II-27 to 3 parts and 7 parts, respectively.

EXAMPLE 13

An electrophotographic photoreceptor was prepared in the same manner as in Example 9, except for changing the amount of polycarbonate (I) to 5 parts.

EXAMPLE 14

An electrophotographic photoreceptor was prepared in the same manner as in Example 9, except for changing the amounts of Compound III-1 and Compound II-27 to 4 parts and 1 parts, respectively.

EXAMPLE 15

An electrophotographic photoreceptor was prepared in the same manner as in Example 9, except for replacing Compound III-1 with Compound III-6.

EXAMPLE 16

An electrophotographic photoreceptor was prepared in the same manner as in Example 9, except for replacing Compound III-1 with Compound III-2.

EXAMPLE 17

An electrophotographic photoreceptor was prepared in the same manner as in Example 9, except for replacing Compound III-1 with Compound III-9.

EXAMPLE 18

An electrophotographic photoreceptor was prepared in the same manner as in Example 9, except for replacing Compound III-1 with Compound III-11.

Comparative Example 16

An electrophotographic photoreceptor was prepared in the same manner as in Example 9, except for replacing polycarbonate (I) with a polycarbonate resin having a recurring unit represented by formula (XII):

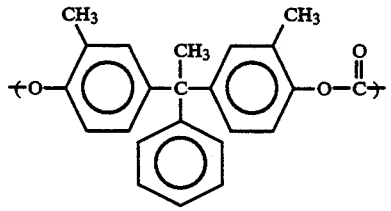

(XII)

Comparative Example 17

An electrophotographic photoreceptor was prepared in the same manner as in Example 9, except for replacing polycarbonate (I) with a polycarbonate resin having a recurring unit represented by the above formula (IX) and replacing monochlorobenzene with methylene chloride.

The photoreceptors prepared in Examples 9 to 18 and Comparative Examples 16 to 17 were evaluated in the same manner as in Example 1. The results obtained are shown in Table 5 below.

TABLE 5

| | Charge Transporting Layer | | | | | | | |
|---|---|---|---|---|---|---|---|---|
| | Charge Transporting Material | | | | | Electric Characteristics | | |
| Example No. | Benzidine Compound (II) (wt %) | Triphenylamine Compound (III) (wt %) | Binder Resin (wt %) | Film Thickness (μm) | Film Properties | $V_0$ (V) | $E_{\frac{1}{2}}$ (erg/cm$^2$) | $V_{RP}$ (V) |
| Example 9 | III-1 (40) | II-27 (10) | (I) (50) | 20.0 | good | −817 | 8.0 | −48 |
| Example 10 | III-1 (40) | II-15 (10) | (I) (50) | 20.1 | good | −811 | 8.2 | −55 |

TABLE 5-continued

| Example No. | Charge Transporting Layer: Charge Transporting Material: Benzidine Compound (II) (wt %) | Triphenylamine Compound (III) (wt %) | Binder Resin (wt %) | Film Thickness (μm) | Film Properties | Electric Characteristics: $V_0$ (V) | $E_{\frac{1}{2}}$ (erg/cm$^2$) | $V_{RP}$ (V) |
|---|---|---|---|---|---|---|---|---|
| Example 11 | III-10 (40) | II-27 (10) | (I) (50) | 20.0 | good | −825 | 7.9 | −52 |
| Example 12 | III-1 (15) | II-27 (35) | (I) (50) | 20.2 | good | −825 | 7.5 | −35 |
| Example 13 | III-I (53) | II-27 (13) | (I) (34) | 19.2 | partly whitened | −786 | 6.9 | −25 |
| Example 14 | III-1 (27) | II-27 (7) | (I) (66) | 21.0 | good | −845 | 8.5 | −65 |
| Example 15 | III-6 (40) | II-27 (10) | (I) (50) | 20.2 | good | −811 | 8.2 | −44 |
| Example 16 | III-2 (40) | II-27 (10) | (I) (50) | 19.9 | good | −814 | 8.0 | −45 |
| Example 17 | III-9 (40) | II-27 (10) | (I) (50) | 20.2 | good | −812 | 7.9 | −52 |
| Example 18 | III-11 (40) | II-27 (10) | (I) (50) | 20.0 | good | −811 | 8.1 | −48 |
| Comparative Example 16 | III-1 (40) | II-27 (10) | (XII) (50) | 20.8 | good | −815 | 7.8 | −41 |
| Comparative Example 17 | III-1 (40) | II-27 (10) | (IX) (50) | 21.2 | good | −818 | 8.1 | −42 |

EXAMPLES 19 to 28

An electrophotographic photoreceptors were prepared in the same manner as in Examples 9 to 18.

Each photoreceptor was set in a digital copying machine ABLE 1301α manufactured by Fuji Xerox Co., Ltd., and 30,000 copies were taken. Image quality of the copies obtained thereafter was evaluated, and the abrasion loss (nm/kcy) of the photosensitive layer was measured. The results obtained are shown in Table 6 below.

Comparative Examples 18 and 19

An electrophotographic photoreceptors were prepared in the same manner as in Comparative Examples 16 and 17.

Each photoreceptor was evaluated in the same manner as in Example 19. The results obtained are shown in Table 6.

TABLE 6

| Example No. | Abrasion Loss (nm/kcy) | Image Quality (after taking 30,000 copies) |
|---|---|---|
| Example 19 | 14.3 | No defect |
| Example 20 | 14.5 | No defect |
| Example 21 | 16.5 | No defect |
| Example 22 | 18.2 | Slight scratches due to abrasion after taking about 10,000 copies. |
| Example 23 | 19.2 | Scratches due to abrasion after taking about 20,000 copies. |
| Example 24 | 12.1 | Fog developed after taking about 20,000 copies. |
| Example 25 | 15.2 | No defect |
| Example 26 | 14.6 | No defect |
| Example 27 | 15.8 | No defect |
| Example 28 | 16.1 | No defect |
| Comparative Example 16 | 40.2 | Scratches due to abrasion. Development of toner filming. |
| Comparative Example 17 | 27.5 | Scratches due to abrasion. Development of toner filming. |

As described above, the electrophotographic photoreceptor according to the present invention is characterized in that the photosensitive layer thereof (or a charge transporting layer in case of a laminate type photosensitive layer) contains, as a charge transporting material, a benzidine compound and/or a low-molecular weight compound having a molecular weight of from 200 to 400 and, as a binder resin, polycarbonate (I) having a viscosity-average molecular weight of from 50,000 to 100,000, said charge transporting material and said binder resin being at a weight ratio of from 25:75 to 60:40. By virtue of this specific combination, the electrophotographic photoreceptor of the present invention exhibits markedly improved abrasion resistance and peeling resistance while retaining high sensitivity and stability on repeated use.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having formed thereon a photosensitive layer containing at least a charge generating material, a charge transporting material, and a binder material, wherein said charge transporting material is a low-molecular weight hydrazone, benzidine or triphenylamine charge transporting material having a molecular weight of from 200 to 400, and said binder resin mainly comprises a polycarbonate resin comprising a recurring unit represented by formula (I):

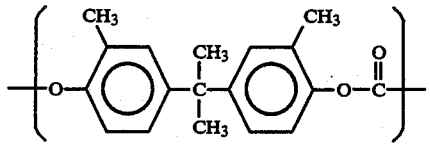

and having a viscosity-average molecular weight ranging from about 60,000 to 100,000, said charge transporting material and said binder resin being at a weight ratio of from 25:75 to 60:40.

2. An electrophotographic photoreceptor as claimed in claim 1, wherein said low-molecular weight charge transporting material is a triphenylamine compound represented by formula (III):

(III)

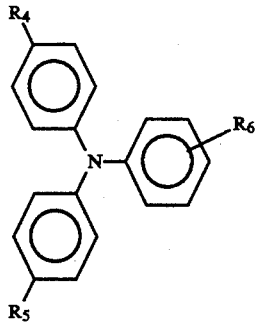

wherein $R_4$ and $R_5$, which may be the same or different, each represent a hydrogen atom, an alkyl group having from 1 to 3 carbon atoms or an alkoxy group having from 1 to 3 carbon atoms; and $R_6$ represents a hydrogen atom, an alkyl group having from 1 to 3 carbon atoms or an aryl group having from 6 to 12 carbon atoms which may be substituted with one or two alkyl groups each having from 1 to 3 carbon atoms.

3. An electrophotographic photoreceptor comprising a conductive substrate having formed thereon a photosensitive layer containing at least a charge generating material, a charge transporting material, and a binder resin, wherein said charge transporting material comprises a benzidine compound represented by formula (II):

(II)

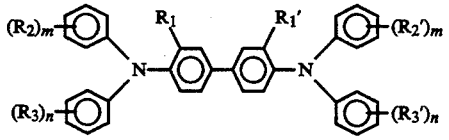

wherein $R_1$ and $R_1'$, which may be the same or different, each represent a hydrogen atom, an alkyl group having from 1 to 5 carbon atoms, an alkoxy group having from 1 to 5 carbon atoms or a halogen atom; $R_2$, $R_2'$, $R_3$, and $R_3'$, which may be the same or different, each represent a hydrogen atom, an alkyl group having from 1 to 5 carbon atoms, an alkoxy group having from 1 to 5 carbon atoms, a halogen atom or a substituted amino group; and m and n each represent 1 or 2, and said binder resin mainly comprises a polycarbonate resin comprising a recurring unit represented by formula (I):

(I)

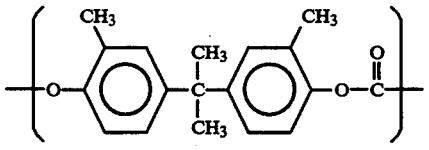

and having a viscosity-average molecular weight ranging from greater than 60,000 to 100,000, said benzidine compound and said binder resin being at weight ratio of from 25:75 to 60:40.

4. An electrophotographic photoreceptor as claimed in claim 3, wherein said charge transporting material further comprises a low-molecular weight charge transporting material having a molecular weight of from 200 to 400.

5. An electrophotographic photoreceptor as claimed in claim 4, wherein a weight ratio of said low-molecular weight charge transporting material and said benzidine compound is from 80:20 to 20:80.

6. An electrophotographic photoreceptor as claimed in claim 5, wherein a weight ratio of said low-molecular weight charge transporting material and said benzidine compound is from 60:40 to 40:60.

7. An electrophotographic photoreceptor as claimed in claim 3, wherein said benzidine compound comprises

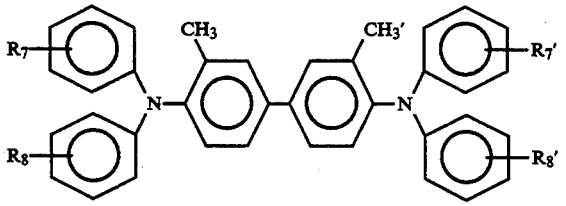

wherein $R_7$, $R_7'$, $R_8$, and $R_8'$, which may be the same or different, each represents a hydrogen atom or a methyl group.

8. An electrophotographic photoreceptor as claimed in claim 3, wherein said benzidine compound comprises

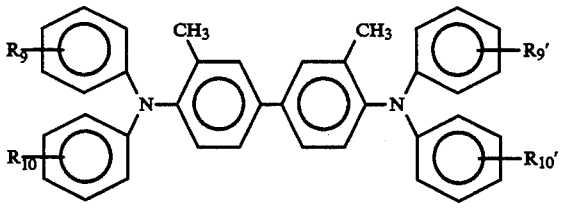

wherein $R_9$ and $R_9'$, which may be the same or different, each represents an alkyl group having two or more carbon atoms; and $R_{10}$ and $R_{10}'$, which may be the same or different, each represents a hydrogen atom, an alkyl group, an alkoxy group or a substituted amino group.

9. An electrophotographic photoreceptor as claimed in claim 1, wherein said charge transporting material is a low molecular weight charge transporting material having a molecular weight of from 200 to 400 represented by the formula

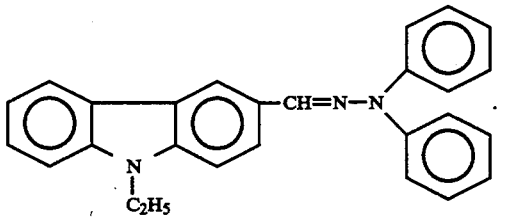

* * * * *